US008714702B2

(12) United States Patent
Zhou et al.

(10) Patent No.: US 8,714,702 B2
(45) Date of Patent: May 6, 2014

(54) ASSISTED MAINTENANCE FOR PRINTHEAD FACEPLATE SURFACE

(75) Inventors: Jing Zhou, Webster, NY (US); Fusheng Xu, Webster, NY (US); James Beachner, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 239 days.

(21) Appl. No.: 13/095,325

(22) Filed: Apr. 27, 2011

(65) Prior Publication Data

US 2012/0274701 A1 Nov. 1, 2012

(51) Int. Cl.
*B41J 2/165* (2006.01)

(52) U.S. Cl.
USPC ..... 347/33; 347/22; 347/28

(58) Field of Classification Search
USPC ..... 347/22, 28, 33
See application file for complete search history.

(56) References Cited

U.S. PATENT DOCUMENTS

| | | | | |
|---|---|---|---|---|
| 4,571,601 | A * | 2/1986 | Teshima | 347/33 |
| 5,300,958 | A | 4/1994 | Burke et al. | |
| 5,905,514 | A | 5/1999 | Rhoads et al. | |
| 5,969,713 | A | 10/1999 | Tomizawa et al. | |
| 7,459,014 | B2 | 12/2008 | Breton et al. | |
| 7,531,582 | B2 | 5/2009 | Toma et al. | |
| 7,538,145 | B2 | 5/2009 | Belelie et al. | |
| 7,563,489 | B2 | 7/2009 | Carlini et al. | |
| 7,625,956 | B2 | 12/2009 | Odell et al. | |
| 7,632,546 | B2 | 12/2009 | Odell et al. | |
| 7,714,040 | B2 | 5/2010 | Toma et al. | |
| 2003/0227504 | A1 * | 12/2003 | Harper | 347/28 |
| 2006/0017769 | A1 * | 1/2006 | Akiyama et al. | 347/28 |

FOREIGN PATENT DOCUMENTS

JP 2006291191 A * 10/2006

OTHER PUBLICATIONS

Derwent abstract of JP 2006-291191 A. (JP 2006-291191 A was published Oct. 26, 2006).*

* cited by examiner

*Primary Examiner* — Justin Seo
(74) *Attorney, Agent, or Firm* — MH2 Technology Law Group LLP

(57) ABSTRACT

An ink jet printhead maintenance system, which can be part of an ink jet printer, for removing ink residue from a printhead faceplate. The printhead maintenance system can include a supply of liquid which can be applied to the ink residue on the printhead faceplate using various techniques, such as those described. The liquid can include a monomer and/or an oligomer. The wet clean system described can be more effective in removing ink residue which can result from certain inks, such as ultraviolet curable gel inks, than previous printhead maintenance techniques.

9 Claims, 8 Drawing Sheets

ASSISTED MAINTENANCE FOR PRINTHEAD FACEPLATE SURFACE

FIELD OF THE INVENTION

The present teachings generally relate to the field of ink jet printers, and more particularly to methods and systems for removing residual ink from a printhead faceplate.

BACKGROUND OF THE INVENTION

In a conventional inkjet printer, a printhead has a series of actuators which ejects printing fluid or ink out of an actuator nozzle and onto an image receiving substrate. The ink drop mass, size, and drop velocity can influence the quality of the printing. Further, a variation in drop speed across the series of actuators can affect the quality of the printing, as drop speed variation can lead to poor image quality.

Conventional piezoelectric inkjet printheads mainly rely on two part processes for jetting: first, ink is drawn into an actuator chamber when a piezoelectric actuator shrinks; and second, the ink is ejected from the actuator chamber through the actuator nozzle when the piezoelectric actuator expands. The shrinking and expanding is achieved by applying an amplified waveform to the actuator.

During the printing process, droplets of ink can collect on the external surface of the printhead faceplate. Additionally, more volatile ink components can evaporate, particularly at elevated temperatures, which can result in ink residue such as ink pigment collecting around the nozzle which can eventually partially or completely plug the actuator nozzle. Furthermore, the residue can form an ink-attractive layer that causes ink to drool from the actuator nozzle during printing. These can adversely affect the printing quality, such as the ink drop mass, velocity, trajectory, and robustness.

To remove the ink droplets from the printhead faceplate surface and the residue from the nozzle, printhead maintenance can be performed. During printhead maintenance, a positive pressure of several psi can be applied to the printhead reservoir, which pushes ink mixed with air bubbles out from the actuator nozzle. Most of the purged ink runs off the printhead because of an anti-wetting coating on the faceplate surface, and only some tiny ink droplets may scatter on the faceplate surface. Then a fluorosilicone blade wiper can be placed against printhead faceplate. The wiper slowly moves from the top to the bottom of faceplate to clean the ink droplets from the faceplate surface.

As ink formulations change and improve, other methods of printhead maintenance are needed.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

In an embodiment of the present teachings, a method for cleaning residue from a printhead faceplate having a plurality of actuator nozzles includes applying a fluid to the printhead faceplate, wherein the fluid includes at least one of a monomer and an oligomer, contacting a surface of a printhead maintenance system with the printhead faceplate, and with the fluid on the faceplate and the surface of the printhead maintenance system in contact with the printhead faceplate, moving the surface of the printhead maintenance system across the printhead faceplate.

In another embodiment of the present teachings, an ink jet printer includes a printhead including a printhead faceplate having a plurality of actuator nozzles, and a printhead maintenance system. The printhead maintenance system can include a surface adapted to contact the printhead faceplate and a quantity of liquid adapted to contact the printhead faceplate and the surface, and further adapted to remove an ink residue from the printhead faceplate during printhead maintenance subsequent to printing, wherein the liquid includes at least one of a monomer and an oligomer.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to the present embodiments (exemplary embodiments) of the present teachings, examples of which are illustrated in the accompanying drawings. Wherever possible, the same reference numbers will be used throughout the drawings to refer to the same or like parts.

The variety of ink formulations for ink jet printers is increasing. Monomer based inks including ultraviolet (UV) curable inks and phase change UV curable inks, for example, contain several components, such as phase change agents and components which aid pigment dispersion.

In particular, phase change UV curable inks such as Xerox's UV curable gel ink has been formulated to have strong adhesion to a wide range of substrates including plain paper, coated papers, plastics, and foils. The UV curable gel ink contains phase change agents, gellant, and acrylate modified wax, and is formulated to control the spreading and coalescence of ink drops on substrates and to reduce showthrough on porous substrates. A dispersant is used to stabilize pigment particles. Various ink formulations which can be used with an embodiment of the present teachings are discussed in the following U.S. Patents, each of which is assigned to Xerox Corporation and incorporated herein by reference in its entirety: U.S. Pat. Nos. 7,459,014, 7,531,582, 7,563,489, 7,625,956, 7,632,546, 7,714,040, and 7,538,145.

New formulations of printer inks can react differently from conventional inks when exposed to the printing process. For example, while new ink formulations can work well for a specific use and/or have improved durability, it has been found that they may not be compatible with current printhead maintenance techniques. UV curable gel ink can adhere more strongly to an actuator nozzle and a faceplate surface than conventional inks. While a faceplate coating can repel dye based solid inks which have a weak adhesion, and can thus be removed during a wiping process during printhead maintenance, new ink formulations can be more difficult to remove from even a coated faceplate surface. Jetting performance can be adversely affected even with a coated faceplate, for example because the monomer of the ultraviolet curable gel ink can slowly evaporate from the actuator nozzles of the heated printhead and result in a solid or semi-solid residue on the inside edge of the actuator nozzle. Conventional printhead maintenance may not be sufficient to recover the jetting performance.

Figure 1:
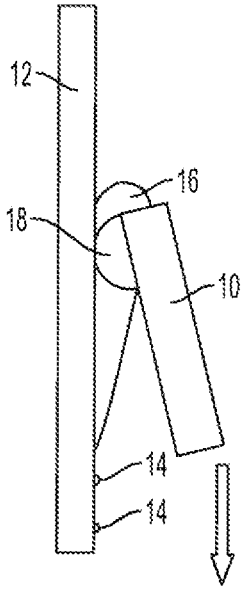
FIG. 1 is a cross section depicting a blade wiper during printhead maintenance, wherein the ink does not wet a surface of a printhead faceplate.
Figure 2:
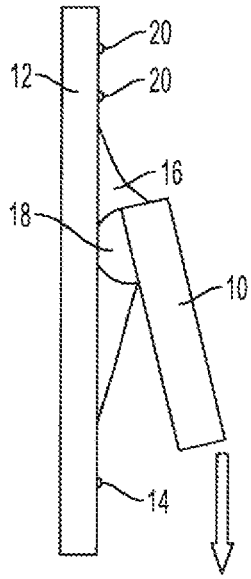
FIG. 2 is a cross section depicting a blade wiper during printhead maintenance, wherein the ink wets a surface of a printhead faceplate.

During printhead maintenance, the ink should not wet the printhead faceplate. As illustrated in FIG. 1, when the blade wiper 10 moves downward relative to the printhead faceplate 12, any ink droplets 14 on the faceplate 12 above the blade wiper 10 should merge into the ink pool 16 behind the blade wiper 10 as a result of surface tension. If the ink does not wet the surface of the faceplate 12, the ink pool 16 moves with the wiper tip 18. This results in few or no ink droplets 14 on the faceplate 12 after wiping. With UV curable gel inks, this wiping process has been found to function as intended for a few printhead maintenance cycles. However, it has been found that after a few printhead maintenance cycles, UV curable gel ink residue continues to accumulate on the printhead faceplate 12, and changes the faceplate surface from a non-wetting surface to a wetting surface as depicted in FIG. 2. This results in ink droplets 20 remaining on the surface of the faceplate 12 subsequent to printhead maintenance. On a poorly cleaned faceplate, the UV curable gel ink can be attracted from the actuator nozzles by the ink droplets remaining on the faceplate, and result in ink drooling from the actuator nozzles, particularly at the lower portion of the faceplate. A negative pressure placed within the printhead reservoir may reduce or eliminate drooling in most cases. However, it is not likely that a negative pressure would prevent dynamic, small ink droplet drooling around the actuator nozzle during jetting. This dynamic drooling can adversely affect jetting performance, and result in poor jetting directionality, ink droplet satellites on the print medium, unstable jetting, and unacceptable variation in ink drop size and velocity during jetting.

Figure 3:
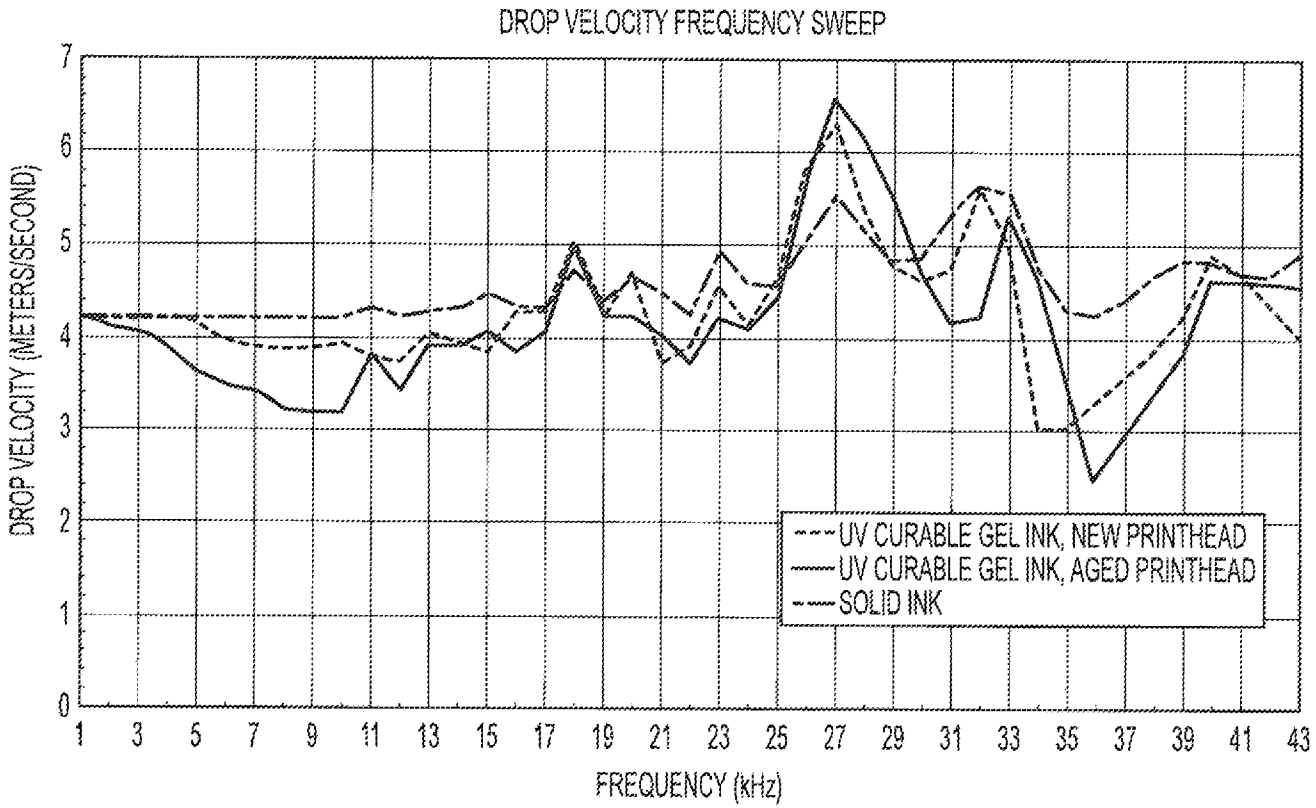
FIG. 3 is a graph depicting drop velocity for a solid ink, an ultraviolet curable gel ink in a new printhead, and an ultraviolet curable gel ink in an aged printhead.

FIG. 3 is a graph comparing drop velocity of a solid ink, a UV curable gel ink during printing with a new printhead, and the UV curable gel ink during printing with an aged printhead. As understood in the art, drop velocity is the average ink drop velocity from the time it is expelled from the actuator nozzle to the time it reaches the substrate upon which the image is to be printed. As depicted in FIG. 3, while there is a small variation with respect to frequency in the solid ink and a medium variation with the new printhead with UV curable gel ink, the variation in drop velocity increases for an aged printhead with UV curable gel ink. For example, at a frequency of 9 KHz, drop velocity is about 0.75 meters/second (m/s) slower for the aged printhead with UV curable gel ink compared to the new printhead with UV curable gel ink. At a frequency of 36 KHz, drop velocity is about 0.8 m/s slower for the aged printhead compared to the new printhead. This variation in drop velocity can result in decreased printing efficiency and poor image production on the print medium.

To overcome this decrease in printing efficiency which can result from ineffective printhead maintenance with certain inks, the present teachings can include a method and apparatus for performing printhead maintenance, for example on an ink jet printhead containing an ink such as a UV curable gel ink. The method and apparatus can include the use of a wet cleaning stage using a fluid that includes, in one embodiment, a liquid monomer or, in another embodiment, an oligomer or, in another embodiment, a similar material to remove the ink residue during printhead maintenance. Various fluids such as propoxylated neopentyl glycol diacrylate, isobornyl acrylate, isobornyl methacrylate, lauryl acrylate, lauryl methacrylate, isodecylacrylate, isodecylmethacrylate, caprolactone acrylate, 2-phenoxyethyl acrylate, isooctylacrylate, isooctylmethacrylate, butyl acrylate, glycerol propoxylated triacrylate, vinyl ethers, vinyl esters, allylic esters or allylic ethers, vinyl or allyl arenes such as styrene and vinyl toluene, and the like or mixtures thereof, can be used. In addition, multifunctional acrylate and methacrylate monomers and oligomers can be included in the fluid. Examples of suitable multifunctional acrylate and methacrylate monomers and oligomers include (but are not necessarily limited to) pentaerythritol tetraacrylate, pentaerythritol tetramethacrylate, 1,2-ethylene glycol diacrylate, 1,2-ethylene glycol dimethacrylate, 1,6-hexanediol diacrylate, 1,6-hexanediol dimethacrylate, 1,12-dodecanol diacrylate, 1,12-dodecanol dimethacrylate, tris(2-hydroxy ethyl)isocyanurate triacrylate, hexanediol diacrylate, tripropylene glycol diacrylate, dipropylene glycol diacrylate, amine modified polyether acrylates (available as PO 83 F, LR 8869, and/or LR 8889, all available from BASF Corporation), trimethylolpropane triacrylate, glycerol propoxylate triacrylate, dipentaerythritol pentaacrylate, dipentaerythritol hexaacrylate, ethoxylated pentaerythritol tetraacrylate (available from Sartomer Co. Inc. as SR 494), pentaerythritol tetra(meth)acrylate, 1,2 ethylene glycol di(meth)acrylate, 1,6 hexanediol di(meth)acrylate, 1,12-dodecanol di(meth)acrylate, and the like, as well as mixtures thereof. The monomer or oligomer based fluids can be more effective in removing the ink residue than, for example, isopropyl alcohol or toluene, at least because these and similar solvents can contaminate the ink within the actuator nozzle and reservoir of the printhead, and have unknown material compatibility issues with the faceplate coating and the individual components of the ink itself. The use of a monomer or oligomer based fluids as a cleaning fluid for monomer-based inks may be advantageous because the monomer or oligomer may dissolve ink components that could potentially be deposited on the printhead front face. Additionally, monomer and oligomer based fluids have a high boiling point and will not quickly evaporate when used at elevated temperatures, thus enabling its additional function as a lubricating fluid in a purge-wipe maintenance cycle.

Figure 4:
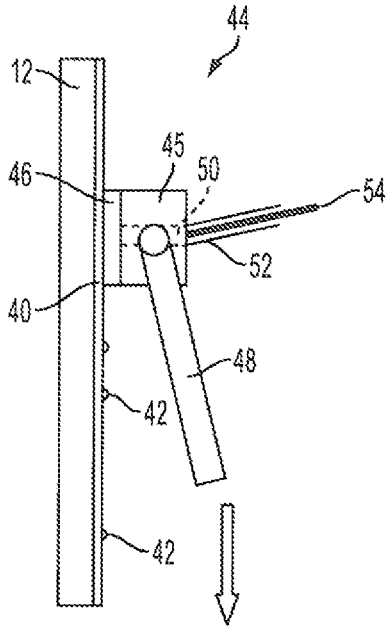
FIGS. 4-7 depict various implementations of wet printhead maintenance systems according to the present teachings.

FIG. 4 depicts a printhead faceplate 12 which can include a coating 40. The printhead faceplate 12 can include ink residue 42, such as ink and/or ink components which can remain on the printhead faceplate 12 subsequent to conventional printhead maintenance. This embodiment can further include a printhead maintenance system 44 having a head 45, a porous pad 46 attached to the head 45, and an arm 48. The head 45 can have a channel 50 which extends from the back surface of the head 45 to the pad 46, with a tube 52 connecting to the channel 50.

In use, a monomer or oligomer based fluid 54 can be pumped from a supply through the tube 52 then through the channel 50, and thereby supplied to the pad 46. In another embodiment, the pad can be dipped into a reservoir of fluid, or other techniques for wetting the pad 46 can be used. Once the pad 46 is sufficiently wet with a quantity of fluid 54, a surface of the pad 46 is contacted with the printhead faceplate 12 and moved across the printhead faceplate 12 with a contact force which is sufficient to remove at least part of the ink residue 42. Some of the fluid is transferred to the printhead faceplate and to the ink residue 42 through contact with the surface of the pad 46. The wet cleaning process can include one or more sweeps of the pad 46, either in one direction or back and forth, across the printhead faceplate 12.

In addition to functioning as an ink-compatible solvent, the monomer or oligomer based fluid 54 can function as a lubricant to reduce friction between the pad 46 and the faceplate 12, which may decrease wear to the coating 40.

The pressure applied between the surface of the pad 46 and the faceplate can be controlled to a certain pressure range. The system can be designed to apply a pressure in the range of between about 1.0 pounds/in$^2$ (psi) and about 100 psi, or between about 5.0 psi and about 30.0 psi, or between about 10 psi and about 20 psi.

Figure 5:
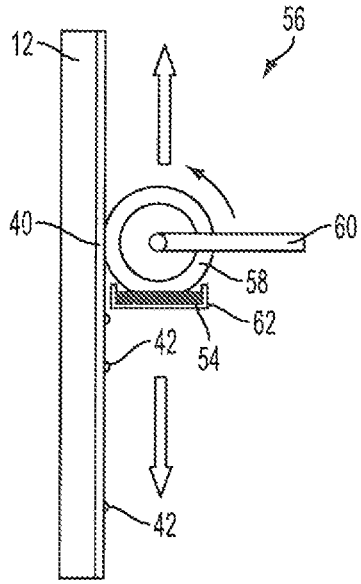

Other methods for removing the ink residue are also contemplated. For example, FIG. 5 depicts a printhead maintenance system 56 including a rotating circular foam roller 58 which can be attached to an arm 60. FIG. 5 further depicts a container 62 with a quantity of fluid 54.

In use, the foam roller 58 rotates through the fluid 54 in the container 62 and picks up a quantity of fluid 54 to sufficiently wet the roller 58 with fluid 54. The surface of the foam roller 58 is contacted with the printhead faceplate 12, for example through pressure on the arm 60, with a force sufficient to remove at least a portion of the ink residue 42. One or more passes of the roller 58 across the faceplate 12 can be performed, either in one direction or back and forth across the faceplate. In an embodiment, the roller can be caused to spin, for example with a motor, at a speed which is either faster or slower than the movement of the roller across the faceplate such that a wiping motion of the roller on the faceplate results. In another embodiment, the roller can be rotated in a direction which is opposite to the movement of the roller across the faceplate (i.e. a counterclockwise rotation if the roller is moving down in the FIG. 5 depiction, or a clockwise rotation if the roller is moving up).

Figure 6:
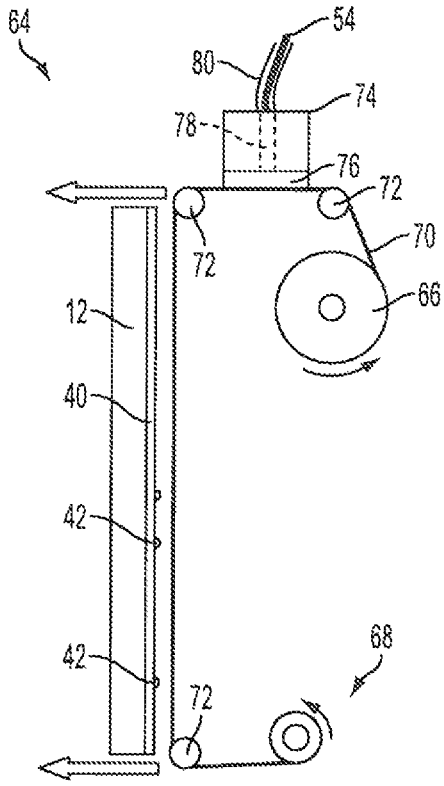

FIG. 6 depicts a printhead maintenance system 64 according to another embodiment. This assembly 64 can include a rotating carrier supply reel 66, a rotating carrier take-up reel 68, and a double-ended carrier 70 (i.e. a double-ended belt). The carrier 70 can be manufactured from a material which is sufficiently porous to absorb a quantity of fluid 54 and sufficiently flexible for transport around a system of tension rollers 72. The system of tension rollers 72 is exemplary, and other arrangements are contemplated. Materials for the carrier can include a strip of woven or non-woven cheesecloth, flannel, rayon, cotton, Dacron®, polyester fibers, polypropylene fibers, paper and cellulosic fibers, nylon, combinations of rayon and cotton, and mixtures thereof. The FIG. 6 assembly can further include a fluid applicator 74 having a porous pad 76, a channel 78, and a tube 80 connected to the fluid applicator 74.

In use, a first end of the carrier 70 is attached to the carrier supply reel 66 and a second end is attached to the take-up reel 68. The carrier take-up reel 68 is caused to spin, for example using a motor, which causes the carrier to be fed from the carrier supply reel 66. Fluid 54 can be supplied to the porous pad 76, for example by pumping fluid 54 from a supply through the tube 80, through the channel 78, and to the porous pad 76. Contact between the porous pad 76 and the carrier 70 transfers fluid 54 to the carrier 70. In another embodiment, the fluid can be pumped from a supply to a jet which sprays the monomer onto the carrier.

As depicted in FIG. 6, the maintenance assembly 64 is moved toward the printhead faceplate 12 such that physical contact between the surface of the moving carrier 70 and the faceplate 12 is established. The physical contact is of sufficient force to at least partially remove the residue 42 from the faceplate 12. The residue 42 can be picked up by the carrier 70 and transported to the take-up reel 68. Fluid 54 on the moving carrier functions as a solvent to dissolve the residue 42.

Once the usable portion of the carrier 70 has been exhausted, the printer can be serviced and a new carrier supply reel 68 can be installed. In another embodiment, the carrier supply is designed to be sufficient to last the lifetime of the printer.

In another embodiment, the carrier 70 can be a continuous belt which rotates around a system of rollers. Fluid can be applied to the carrier using the method described with reference to FIG. 6, or another method. The surface of the rotating belt which is wet with fluid can be contacted against the printhead faceplate with a force sufficient to remove at least a portion of the ink residue from the printhead faceplate. In an embodiment, once a buildup of ink residue is sufficient, the belt can be cleaned or replaced. In another embodiment, the belt can be designed to last the lifetime of the printer.

Figure 7:
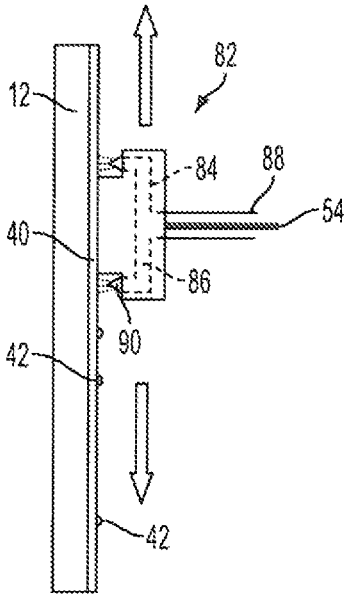

FIG. 7 depicts a printhead maintenance system 82 according to another embodiment. The printhead maintenance system 82 can include a fluorosilicone blade wiper 84 having one or more channels 86 and a tube 88 which connects to the blade wiper 84. Each channel 86 can end in a jet 90.

In use, the surface of the blade wiper 84 is contacted against and moved across the printhead faceplate 12. Fluid 54 is supplied to the jets 90, for example by pumping fluid 54 through the tube 88, through the channel 86, and to the jet 90. The fluid 54 dissolves the residue 42 and the contact with the blade wiper 84 removes at least a portion of the residue from the faceplate 12.

In another embodiment, the blade includes at least a pair of jets. The fluid can be selectively supplied to the jets, for example to the bottom jet 90 but not the top jet 90 as the blade wiper 84 is moving down across the faceplate 12, and to the top jet 90 but not the bottom jet 90 as the blade wiper 84 is moving up across the faceplate 12 to minimize fluid use and runoff.

Figure 8:
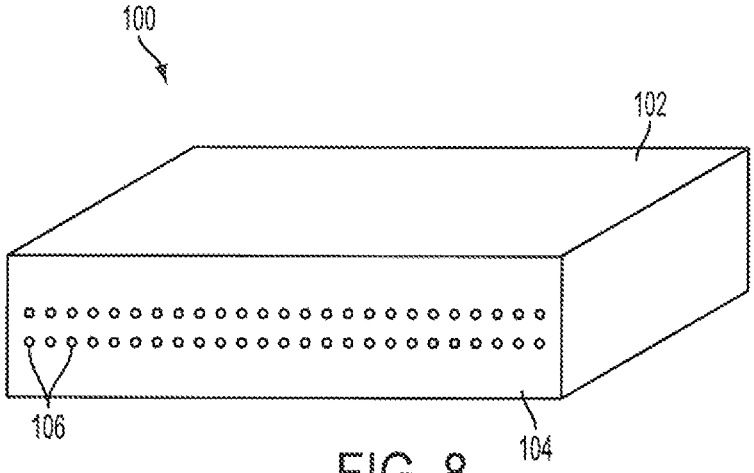
FIG. 8 is a perspective view depicting an ink jet printhead.

FIG. 8 is a perspective view of an ink jet printhead 100 including an ink supply reservoir 102, a faceplate 104, and a plurality of actuator nozzles 106 adapted to eject a volume of ink during printing. It will be realized that FIG. 8 is not to scale and may include other design forms as well as other structures such as drive electronics and conductive interconnects and traces, which can be part of a flexible circuit (flex circuit).

Figure 9:
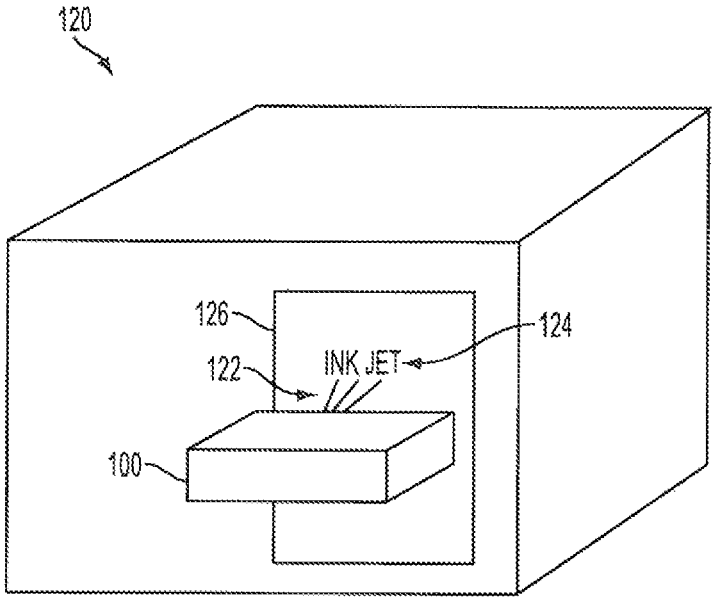
FIG. 9 is a schematic view depicting an ink jet printer which can include a printhead maintenance system according to an embodiment of the present teachings.

FIG. 9 is a schematic view which represents a printer 120 including one or more printheads 100 and ink 122 being ejected from one or more actuator nozzles 106 (FIG. 8) in accordance with an embodiment of the present teachings. The printhead 100 is operated in accordance with digital instructions to create a desired image 124 on a print medium 126 such as a paper sheet, plastic, etc. The printhead 100 may move back and forth relative to the print medium 126 in a scanning motion to generate the printed image swath by swath. Alternately, the printhead 100 may be held fixed and the print medium 126 moved relative to it, creating an image as wide as the printhead 100 in a single pass. The printhead 100 can be narrower than, or as wide as, the print medium 126. The printer 120 includes a printhead maintenance system in accordance with the present teachings as described above. Subsequent to printing, printhead maintenance can be performed on the printhead in accordance with the present teachings.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. In addition, while a particular feature of the disclosure may have been described with respect to only one of several implementations, such feature may be combined with one or more other features of the other implementations as may be desired and advantageous for any given or particular function. It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a wafer or substrate, regardless of the orientation of the wafer or substrate. The term "horizontal" or "lateral" as used in this application is defined as a plane parallel to the conventional plane or working surface of a wafer or substrate, regardless of the orientation of the wafer or substrate. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the wafer or substrate, regardless of the orientation of the wafer or substrate.

The invention claimed is:

1. A method for cleaning residue from a printhead faceplate having a plurality of actuator nozzles, comprising:

applying a fluid to a porous pad on a front of a printhead maintenance system using a method comprising:

pumping the fluid through a tube and through a channel that extends from a back of the fluid applicator to the porous pad at the front of the fluid applicator; and contacting a fluid carrier with the porous pad to transfer the fluid from the porous pad to the fluid carrier;

contacting the fluid carrier with the printhead faceplate, thereby applying the fluid to the printhead faceplate, wherein the fluid comprises at least one of a monomer and an oligomer;

and with the fluid on the faceplate and the surface of the fluid carrier in contact with the printhead faceplate, moving the fluid carrier across the printhead faceplate.

2. The method of claim 1, further comprising:

transferring an ink residue from the printhead faceplate to the fluid carrier during the moving of the fluid carrier across the printhead faceplate.

3. The method of claim 2, wherein the application of the fluid further comprises applying at least one liquid selected from the group consisting of propoxylated neopentyl glycol diacrylate, isobornyl acrylate, isobornyl methacrylate, lauryl acrylate, lauryl methacrylate, isodecylacrylate, isodecylmethacrylate, caprolactone acrylate, 2-phenoxyethyl acrylate, isooctylacrylate, isooctylmethacrylate, butyl acrylate, glycerol propoxylated triacrylate, vinyl ethers, vinyl esters, allylic esters, allylic ethers, vinyl arenes, allyl arenes, pentaerythritol tetraacrylate, pentaerythritol tetramethacrylate, 1,2-ethylene glycol diacrylate, 1,2-ethylene glycol dimethacrylate, 1,6-hexanediol diacrylate, 1,6-hexanediol dimethacrylate, 1,12-dodecanol diacrylate, 1,12-dodecanol dimethacrylate, tris(2-hydroxy ethyl)isocyanurate triacrylate, hexanediol diacrylate, tripropylene glycol diacrylate, dipropylene glycol diacrylate, amine modified polyether acrylates, trimethylolpropane triacrylate, glycerol propoxylate triacrylate, dipentaerythritol pentaacrylate, dipentaerythritol hexaacrylate, ethoxylated pentaerythritol tetraacrylate, pentaerythritol tetra(meth)acrylate, 1,2 ethylene glycol di(meth)acrylate, 1,6 hexanediol di(meth)acrylate, and 1,12-dodecanol di(meth)acrylate.

4. The method of claim 3, further comprising:

printing an image with an ink jet ink comprising an ultraviolet curable gel ink; and forming the residue during the printing of the image.

5. The method of claim 1, wherein the fluid carrier comprises a first end and a second end, and the method further comprises:

moving the fluid carrier across the printhead faceplate by spinning a carrier take-up reel, wherein the spinning of the carrier take-up reel causes the fluid carrier to be fed from a carrier supply reel.

6. An ink jet printer, comprising:

a printhead comprising a printhead faceplate having a plurality of actuator nozzles;

a printhead maintenance system comprising:

a fluid carrier configured to contact the printhead faceplate;

a fluid applicator comprising a porous pad at a front surface of the fluid applicator and a channel that extends from a back of the fluid applicator to the porous pad at the front of the fluid applicator, wherein the channel is configured to supply fluid from the back of the fluid applicator to the porous pad; and the porous pad is configured to transfer the fluid to the fluid carrier through contact with the fluid carrier;

a pump configured to pump the fluid through a tube and through the channel, which is downstream of the tube;

a quantity of the fluid configured for transfer from the porous pad to the fluid carrier through contact with the fluid carrier and to contact the printhead faceplate, and further configured to remove an ink residue from the printhead faceplate during printhead maintenance subsequent to printing, wherein the fluid comprises at least one of a monomer and an oligomer.

7. The ink jet printer of claim 6, wherein:

the quantity of the fluid comprises at least one of propoxylated neopentyl glycol diacrylate, isobornyl acrylate, isobornyl methacrylate, lauryl acrylate, lauryl methacrylate, isodecylacrylate, isodecylmethacrylate, caprolactone acrylate, 2-phenoxyethyl acrylate, isooctylacrylate, isooctylmethacrylate, butyl acrylate, glycerol propoxylated triacrylate, vinyl ethers, vinyl esters, allylic esters, allylic ethers, vinyl arenes, allyl arenes, pentaerythritol tetraacrylate, pentaerythritol tetramethacrylate, 1,2-ethylene glycol diacrylate, 1,2-ethylene glycol dimethacrylate, 1,6-hexanediol diacrylate, 1,6-hexanediol dimethacrylate, 1,12-dodecanol diacrylate, 1,12-dodecanol dimethacrylate, tris(2-hydroxy ethyl)isocyanurate triacrylate, hexanediol diacrylate, tripropylene glycol diacrylate, dipropylene glycol diacrylate, amine modified polyether acrylates, trimethylolpropane triacrylate, glycerol propoxylate triacrylate, dipentaerythritol pentaacrylate, dipentaerythritol hexaacrylate, ethoxylated pentaerythritol tetraacrylate, pentaerythritol tetra(meth)acrylate, 1,2 ethylene glycol di(meth)acrylate, 1,6 hexanediol di(meth)acrylate, and 1,12-dodecanol di(meth)acrylate.

8. The ink jet printer of claim 6, wherein the printhead further comprises:

an ink reservoir; and a volume of ink jet ink within the ink reservoir, wherein the ink jet ink comprises ultraviolet curable gel ink.

9. The ink jet printer of claim 6, wherein:

the fluid carrier comprises a first end attached to a carrier supply reel and a second end attached to a carrier take-up reel; and the carrier take-up reel is adapted to spin to feed the fluid carrier from the carrier supply reel across the printhead faceplate.

* * * * *